United States Patent [19]

Ward, II

[11] Patent Number: 4,798,273

[45] Date of Patent: Jan. 17, 1989

[54] PARKING METER ANCHOR

[75] Inventor: Seth Ward, II, Little Rock, Ark.

[73] Assignee: POM Incorporated, Russellville, Ark.

[21] Appl. No.: 927,375

[22] Filed: Nov. 6, 1986

[51] Int. Cl.[4] ..... G07F 9/00

[52] U.S. Cl. ..... 194/350; 403/369; 411/55; 52/701; 52/704

[58] Field of Search ..... 194/350, 353; 368/90, 368/91, 92; 403/369, 370; 411/44, 55, 71, 72, 77; 405/259, 260, 261; 52/698, 701, 704, 705, 706, 707, 708; 232/7, 15, 16

[56] References Cited

U.S. PATENT DOCUMENTS

| | | | |
|---|---|---|---|
| 2,139,167 | 12/1938 | Marshall | 411/55 |
| 2,304,012 | 12/1942 | Neff | 368/90 X |
| 2,311,242 | 2/1943 | Michaels | 368/90 X |
| 2,323,402 | 7/1943 | Jones | 368/91 |
| 3,026,022 | 3/1962 | Curry | 232/16 X |
| 3,268,158 | 8/1966 | Abbott | 232/15 X |
| 3,776,651 | 12/1973 | Peter et al. | 403/370 X |
| 3,941,028 | 3/1976 | Lobello et al. | 411/55 |
| 4,380,407 | 4/1983 | Donan, Jr. | 405/259 |
| 4,592,687 | 6/1986 | Piersall | 411/55 X |

FOREIGN PATENT DOCUMENTS

| | | | |
|---|---|---|---|
| 0640059 | 12/1978 | U.S.S.R. | 411/44 |

*Primary Examiner*—Joseph J. Rolla
*Assistant Examiner*—Edward S. Ammeen
*Attorney, Agent, or Firm*—Hill, Van Santen, Steadman & Simpson

[57] ABSTRACT

A parking meter anchor includes a mounting bolt extending from a vault chamber of the parking meter head through a tapered mounting base extending therefrom and into an interior of a hollow post. An anchor nut is received on the mounting bolt and carries toothed expansion wedges which are held against an inside of the post by tapered surfaces of the mounting base and by radially extending tongues on the anchor nut.

3 Claims, 1 Drawing Sheet

PARKING METER ANCHOR

BACKGROUND OF THE INVENTION

1. Field of the Invention

The present invention relates generally to an anchoring device and, more particularly, to an anchor for connecting a parking meter to a post.

2. Description of the Prior Art

Parking meters accept payment and count down a time interval, generally for short-term parking in a vehicle parking space. A parking meter usually includes a head portion mounted on a post, the head holding the money or other credit tokens received for the parking fees. The known parking meter heads are relatively tamper-resistant so that unauthorized extraction of the money from the meter is quite difficult.

However, it has frequently been the case that the parking meter heads are removed from the post and carried away so that they can be broken into later. To prevent this, an expanding anchor nut assembly has been used in the prior art parking meters to affix the meter head to the post. The expanding anchor nut assembly includes an anchor nut and wedge assembly within the hollow post which is tightened by a bolt extending from within the parking meter, resulting in an outward pressure on the post. Although the outward expansion of the known anchor nut assemblies exert considerable pressure on the inside of the post, it is still possible to strike upwardly on the meter head and cause the anchor nut assembly to slide up and out of the post without too much difficulty.

In an attempt to thwart the removal of parking meter heads from their posts, it has become the practice in some localities to drive an anchor nil through both the post and the meter head by the use of a Hilti gun to provide a theft-proof connection therebetween. However, a drawback of this procedure is that the post must be cut off when the municipality or other parking authority wishes to remove the meter, such as for repair or replacement. Thus, a considerable inconvenience and expense is involved by this technique.

SUMMARY OF THE PRESENT INVENTION

The present invention provides a tamper-proof connection between a parking meter head and a parking meter post, yet enables the parking meter head to be removed from the post when so desired. The tamper-proof connection includes a plurality of toothed expansion wedges disposed within the mounting post and connected to a lower portion of the parking meter head. In a preferred embodiment, the expansion wedges are slidably mounted on an anchor nut which is threadably received on a mounting bolt that extends upward into the vault cavity or other interior portion of the parking meter head. The mounting bolt is tightened to draw the anchor nut upward, causing the expansion wedges to move both upwardly and outwardly as the result of contact with a tapered lower portion of the meter head. The teeth on the expansion wedges bite into the mounting post to prevent the meter head from being driven or beaten upwardly off the post. It is also contemplated to provide a shaped head on the mounting bolt for receiving the anchor wedges and to have a nut within the vault threadably received on the mounting bolt for tightening.

Should removal of the parking meter head be desired by the parking authorities, the mounting bolt can be loosened from within the vault or other meter interior to eliminate the outward pressure on the toothed expansion wedges and thereby enable the parking meter head to be removed from the post. Since the unauthorized removal of parking meters from their posts is generally to gain access to the vault chamber, placement of the release means within the vault deters theft of the entire meter, as well as safely protecting the release means.

The present invention, thus, provides an anchoring means for a parking meter which effectively prevents thieves and vandals from removing the parking meter head, yet enables someone who has access to the money vault or interior of the meter head to remove the head from the post easily.

DESCRIPTION OF THE PREFERRED EMBODIMENTS

Figures 1, 2, 3, 4, 5, 6:
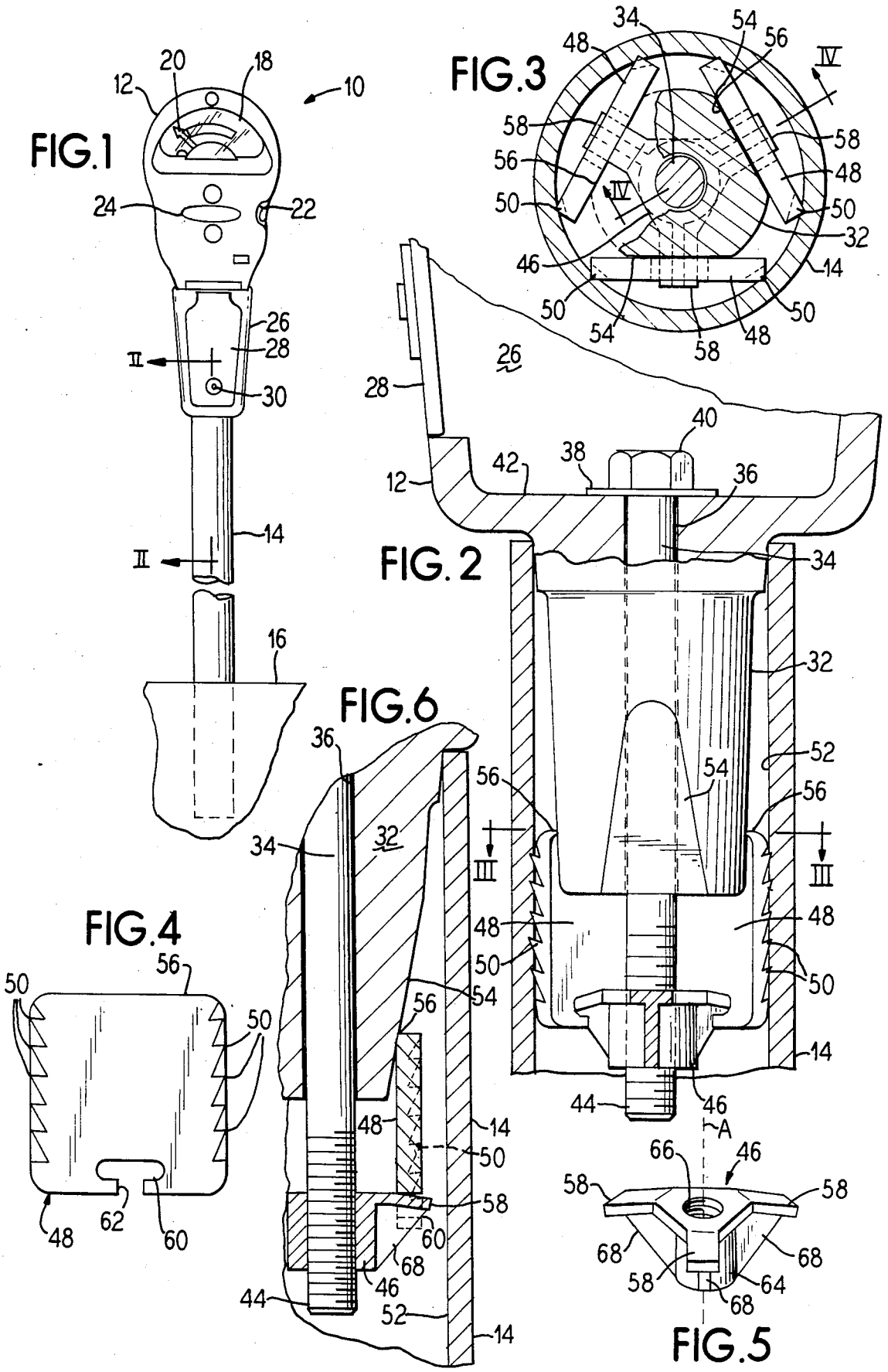
FIG. 1 is a front elevational view of a parking meter mounted on a post by an anchor according to the principles of the present invention.
FIG. 2 is a cross section along line II—II of FIG. 1 showing a parking meter anchor of the present invention.
FIG. 3 is a cross section along line III—III of FIG. 2 showing the present anchor holding a parking meter within a hollow post.
FIG. 4 is an elevational view of a toothed expansion wedge of the present invention.
FIG. 5 is a perspective view of an anchor nut of the present invention.
FIG. 6 is a fragmentary cross section showing the present parking meter anchor before engagement against the inside of the parking meter post.

In FIG. 1 a parking meter denoted generally at 10 comprises a head 12 which is mounted on a hollow cylindrical post, or pole, 14, the post 14 in turn being mounted in, for example, a concrete sidewalk 16. The head 12 includes a transparent display window 18 through which may be viewed a time remaining indicator, shown here as a pointer 20. Upon time running out, the pointer 20 is replaced by a violation indicator (not shown). A coin slot 22 accepts coins or other credit tokens and a rotatable handle 24 operates the crediting mechanism (not shown) within the head 12 after insertion of a coin or token into the coin slot 22 to initiate the countdown of a time duration by a timing mechanism (not shown). The lower end of the head 12 mounted to the post 14 includes a coin vault 26 into which the coins or other credit tokens are deposited following insertion into the coin slot 22. The coin vault has an openable door 28, the door 28 being openable by manipulation of a key in a lock opening 30. Other vault opening means may be provided as well, so long as they are secure against tampering.

In FIG. 2, the meter head 12 includes a tapered mounting base, or peg, 32 extending into the post 14. A mounting bolt 34 extends through a bore 36 which passes centrally through the tapered base 32 and into the vault 26. The bore 36 and the bolt 34 therein lie generally along the rotational axis of the cylindrical post 14. A washer 38 is provided between a head 40 of the bolt 34 and a floor surface 42 of the vault 26. An opposite end 44 of the mounting bolt 34 is threaded and an anchor nut 46 is threadably received thereon, the anchor nut 46 carrying a plurality of expansion wedges 48. The wedges 48 each include a plurality of teeth 50 which engage an inside surface 52 of the hollow post 14. The anchor nut 46 holds the expansion wedges 48 between the tapered base 32 and the inside surface 52. In the illustrated embodiment, the tapered base 32 is provided with flat beveled, or tapered, surfaces 54 against which rest a top edge 56 of each of the wedges 48.

With reference to FIG. 3, the cylindrical post 14 encloses three of the expansion wedges 48. The wedges 48 have their top edge surfaces 56 abutting the three equally spaced beveled surfaces 54 on the tapered base 32 so that the teeth 50, which are on opposite sides of the wedges 48 engage the post 14. Each of the wedges 48 is supported at its horizontal mid-portion by a tongue 58 extending radially outward from the anchor nut 46.

In FIG. 4, an individual one of the expansion wedges 48 is shown having the teeth 50 formed in two opposite sides thereof. An open slot 60 adjacent the bottom of the expansion wedge 48 accepts one of the tongues 58 extending from the anchor nut 46. The slot 60 includes a channel 62 extending to the edge of the wedge 48. The expansion wedge 48 in its preferred embodiment is extremely simple to manufacture. The overall shape of the wedge 48 is formed from sheet material, the open slot 60 is formed and notches are cut into opposite edges of the wedge 48 to form the teeth 50.

The anchor nut 46 is shown in FIG. 5 and includes three equally spaced tongues 58 extending from a central cylinder, or body, 64 through which a threaded bore 66 extends. Each of the tongues 58 includes a support flange 68 extending between a lower side of the tongue 58 and the cylindrical body 64 for added strength. The tongues 58 are received in the slot 60 in the expansion wedges 48, with clearance for the support flange 68 being provided by the channel 62. Each of the tongues 58 is sloped downwardly somewhat with respect to a plane perpendicular to an axis A that extends through the bore 66 in the anchor nut 46, and along the bolt 34 when the nut 46 is on the bolt 34.

Referring now to FIG. 6, the present parking meter is secured, or anchored, within a post 14 by inserting the tapered base 32 thereof into an open end of the post 14. The mounting bolt 34 is disposed extending through the bore 36 in the base 32 with the anchor nut 46 threadably received on the lower end 44 thereof. Each of the anchor wedges 48 is mounted on one of the tongues 58 extending from the anchor nut 46. After the tapered base 32 and the assembled parts are inserted into the open top of the post 14, the head 40 of the mounting bolt 34 is rotated to cause the anchor nut 46 to move upward on the bolt 34, thereby carrying the anchor wedges 48 into the increasingly narrow space between the tapered surfaces 54 and the inside surface 52 of the post 14. The flat tapered surfaces 54 prevent the wedges 48 from rotating within the pipe 14 and, thus, prevent the anchor nut 46 from rotating. The bolt 34 is rotated until the teeth 50 engage the inner surface 52. The sloped tongues 58 of the anchor nut 46 move the lower end of the anchor wedges 48 radially outward as the upper edges 56 of the wedges 48 are moved outward by the tapered surfaces 54. When the teeth 50 are against the inner surface 52, the mounting bolt 34 is further tightened to drive the teeth 50 into the inner surface 52. In a preferred development, the teeth 50 are of hardened steel, such as heat treated steel, and the expansion wedges 48 will thus approximate spring steel so that the teeth 50 cut and bite into the inside surface 52 of the pole 14.

Thus, the toothed expansion wedges 48 hold the parking meter head 12 onto the pole 14 and prevent its upward movement with respect thereto. Should an attempt be made to remove the parking meter 12, the teeth 50 bite into the inner surface 52 to so securely engage the post 14 that portions of the post 14 are torn away if the removal attempts are continued. Thus, the present invention successfully deters attempted theft of the parking meter head 12.

Should removal of the parking meter head 12 be desired by the municipality or other parking authority, the mounting bolt 34 is simply loosened until the meter 12 can be removed. This may require rotation of the bolt 34 until the anchor nut 46 is free from the end 44, since the teeth 50 are embeded in the inside surface 52. Removal would, of course, be accomplished by opening the door 28 of the vault 26 and, thus, could be done only by someone who has access to the vault chamber 26. Since access to the vault chamber 26 is the reason for unauthorized removal of the meter 12, it is expected that should the vault door 28 be opened for unauthorized removal of the money therein, the meter 12 will not be thereafter stolen.

The present invention, therefore, provides a means for easily and securely mounting a parking meter head to a post so that it cannot be removed therefrom by unauthorized persons, yet can be relatively easily removed by someone with access to the vault chamber.

The toothed anchor is disclosed herein in conjunction with a parking meter head. However, it may also be used to mount a variety of other devices at elongated openings. Also, the mounting bolt can be inverted with the head thereof shaped to hold the expansion wedges. Alternately, other means for drawing the expansion wedges toward the tapered mounting base may be included. It is also contemplated to provide the toothed expansion wedges with a tapered inner surface, in which case the beveled surfaces on the mounting base is not required.

Although other modifications and changes may be suggested by those skilled in the art, it is the intention of the inventor to embody within the patent warranted hereon all changes and modifications as reasonably and properly come within the scope of his contribution to the art.

I claim as my invention:

1. A parking meter for mounting on a hollow post, comprising:

a head including a parking time indicator and an opening for receiving coins and the like;

a vault chamber mounted below said head for receiving the coins and the like received in said opening and including an openable door;

a tapered mounting base extending from said vault chamber and received in the hollow post, said mounting base including a plurality of beveled surfaces and an opening extending through said mounting base and opening into an interior of the hollow post;

a mounting bolt extending through said opening in said mounting base, said mounting bolt including means for rotating said mounting bolt from within said vault member;

an anchor nut threadably received on the portion of said mounting bolt extending into the interior of the post; and a plurality of expansion wedges of substantially rectangular shape mounted on said anchor nut for restricted longitudinal movement and for free radial movement, said plurality of expansion wedges being flat and including a plurality of angular teeth on first and second opposite sides of said expansion wedges, said first and second opposite sides being urged against and in engaging contact with an inside surface of the post, a top edge of respective ones of said expansion wedges being in contact with said plurality of tapered surfaces of said mounting base to urge said angular teeth on opposite sides of said expansion wedges against said inside surface and prevent removal of said parking meter from the hollow post.

2. A parking meter as claimed in claim 1, wherein said mounting base includes three of said tapered surfaces, said anchor nut including three equally spaced radially extending tongues, each of said radially extending tongues having a support flange, and further comprising three of said expansion wedges mounted on said anchor nut, each of said expansion wedges including a shaped slot receiving a respective one of said tongues and support flanges.

3. A parking meter for mounting on a hollow cylindrical mounting post to indicate a time interval for authorized vehicular parking, comprising:

a meter housing including a vault chamber for accepting credit tokens;

a mounting peg extending from said meter housing into the hollow interior of said cylindrical mounting post, said mounting peg having three equally spaced tapered lateral surfaces and a central bore extending substantially along the rotational axis of said cylindrical mounting post, said central bore extending into said vault chamber;

a mounting bolt extending through said central bore and having a head disposed within said vault chamber and a threaded shaft extending from said mounting peg into the interior of said mounting post;

an anchor nut having an internally threaded central opening threadably received on said threaded shaft of said mounting bolt, said anchor nut having a body portion around said central opening and three equally spaced tongue members extending radially from said body portion, each of said tongue members being at an acute angle to a rotational axis of said threaded central opening, said anchor nut including three support flanges, each of said support flanges extending between said body portion and respective one of said tongue members; and three planar expansion wedges within said hollow mounting post, each of said planar expansion wedges having a substantially rectangular shape with angular teeth formed in first and second opposing sides, said angular teeth being disposed against an inside surface of said hollow mounting post, an open slot formed in a third side of each of said expansion wedges substantially midway between said first and second opposing sides, ones of said tongue members being received in respective ones of said open slots;

a fourth side of said expansion wedges being opposite said third side and disposed against respective ones of said tapered lateral surfaces of said mounting peg;

whereby said angular teeth of said expansion wedges bite into an inside surface of said mounting post to securely hold said parking meter to said mounting post.

* * * * *